US008281879B2

(12) United States Patent
Elliott et al.

(10) Patent No.: US 8,281,879 B2
(45) Date of Patent: Oct. 9, 2012

(54) METHOD OF DRILLING A WELLBORE

(75) Inventors: David Allan Elliott, Rijswijk (NL); Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/811,543

(22) PCT Filed: Dec. 24, 2008

(86) PCT No.: PCT/EP2008/068298

§ 371 (c)(1),
(2), (4) Date: Sep. 9, 2010

(87) PCT Pub. No.: WO2009/087069

PCT Pub. Date: Jul. 16, 2009

(65) Prior Publication Data

US 2011/0278009 A1 Nov. 17, 2011

(30) Foreign Application Priority Data

Jan. 4, 2008 (EP) ..... 08100116

(51) Int. Cl.
*E21B 7/20* (2006.01)

(52) U.S. Cl. ..... 175/171; 175/57; 175/320; 166/207

(58) Field of Classification Search ..... 166/277, 166/384, 207, 242.2, 285, 287, 177.4; 175/57, 175/171, 172, 320
See application file for complete search history.

(56) References Cited

U.S. PATENT DOCUMENTS 4,501,337 A 2/1985 Dickinson, III et al. ..... 175/171
5,169,264 A * 12/1992 Kimura ..... 405/184
5,309,994 A * 5/1994 Douglas et al. ..... 166/278
5,634,743 A * 6/1997 Chandler ..... 405/150.1
5,803,666 A * 9/1998 Keller ..... 405/146
5,853,049 A * 12/1998 Keller ..... 166/380
5,971,031 A * 10/1999 Kamiyama et al. ..... 138/98
5,993,114 A * 11/1999 Jones ..... 405/150.1
6,006,787 A * 12/1999 Kamiyama et al. ..... 138/98
6,109,828 A * 8/2000 Keller ..... 405/146
6,311,730 B2 * 11/2001 Penza ..... 138/98
6,446,670 B1 * 9/2002 Woodward et al. ..... 138/98
6,871,532 B2 * 3/2005 Zazovsky ..... 73/152.05
6,932,116 B2 8/2005 Smith et al. ..... 138/98

(Continued)

FOREIGN PATENT DOCUMENTS

DE 1189492 3/1965

(Continued)

*Primary Examiner* — Jennifer H Gay
*Assistant Examiner* — Tamatane Aga

(57) ABSTRACT

A method of drilling a wellbore comprises arranging a drill string and an expandable tubular in the wellbore such that a lower end portion of the wall of the tubular extends radially outward and in an axially reverse direction so as to form an expanded section extending around a remaining section of the tubular, drill string extending through the remaining section, and axially extending the expanded section by moving the remaining section downward relative to the expanded section so that the lower end portion of the wall bends radially outward and in an axially reverse direction, wherein the expanded section covers the wellbore wall in an upper portion of the wellbore. The drill string is operated so as to drill a lower wellbore portion, and a compound is transferred between the lower wellbore portion and a layer of the earth formation surrounding the lower wellbore portion.

8 Claims, 1 Drawing Sheet

U.S. PATENT DOCUMENTS

| | | | | |
|---|---|---|---|---|
| 6,953,307 | B2 * | 10/2005 | Graham | 405/184.1 |
| 7,096,890 | B2 * | 8/2006 | Woolstencroft et al. | 138/98 |
| 7,150,328 | B2 | 12/2006 | Marketz et al. | 166/380 |
| 7,281,422 | B2 * | 10/2007 | Keller | 73/152.41 |
| 7,387,174 | B2 * | 6/2008 | Lurie | 175/57 |
| 7,464,774 | B2 | 12/2008 | Savignat et al. | 175/385 |
| 7,896,578 | B2 * | 3/2011 | Keller | 405/150.1 |
| 7,946,349 | B2 | 5/2011 | Kriesels | 166/384 |
| 8,056,641 | B2 | 11/2011 | Kriesels et al. | 166/384 |
| 8,056,642 | B2 | 11/2011 | Kriesels et al. | 166/384 |
| 8,141,647 | B2 | 3/2012 | Kriesels et al. | 166/380 |
| 2003/0084715 | A1 * | 5/2003 | Zazovsky | 73/152.05 |
| 2004/0129456 | A1 * | 7/2004 | Vail, III | 175/57 |
| 2005/0172710 | A1 | 8/2005 | Keller | 73/152.41 |
| 2007/0017669 | A1 * | 1/2007 | Lurie | 166/177.4 |
| 2007/0144784 | A1 * | 6/2007 | Head et al. | 175/57 |
| 2007/0169540 | A1 * | 7/2007 | Sterner et al. | 73/19.09 |
| 2009/0255689 | A1 * | 10/2009 | Kriesels et al. | 166/384 |
| 2009/0288842 | A1 * | 11/2009 | Kriesels | 166/384 |
| 2010/0089593 | A1 * | 4/2010 | Hou et al. | 166/384 |
| 2010/0243275 | A1 | 9/2010 | Kriesels | 166/384 |
| 2010/0252333 | A1 | 10/2010 | Blange et al. | 175/424 |
| 2010/0263878 | A1 | 10/2010 | Van Nieuwkoop | 166/384 |
| 2010/0270036 | A1 | 10/2010 | Kriesels | 166/384 |
| 2010/0270037 | A1 | 10/2010 | Kriesels et al. | 166/384 |
| 2010/0276157 | A1 | 11/2010 | Kriesels | 166/381 |
| 2010/0276202 | A1 | 11/2010 | Kriesels | 175/61 |
| 2010/0294487 | A1 | 11/2010 | Kriesels | 166/207 |
| 2011/0266007 | A1 | 11/2011 | Hou | 166/384 |

FOREIGN PATENT DOCUMENTS

| | | |
|---|---|---|
| EP | 0044706 | 1/1982 |
| WO | WO 9947340 | 9/1999 |
| WO | WO03036025 | 5/2003 |
| WO | WO2005024178 | 3/2005 |

* cited by examiner

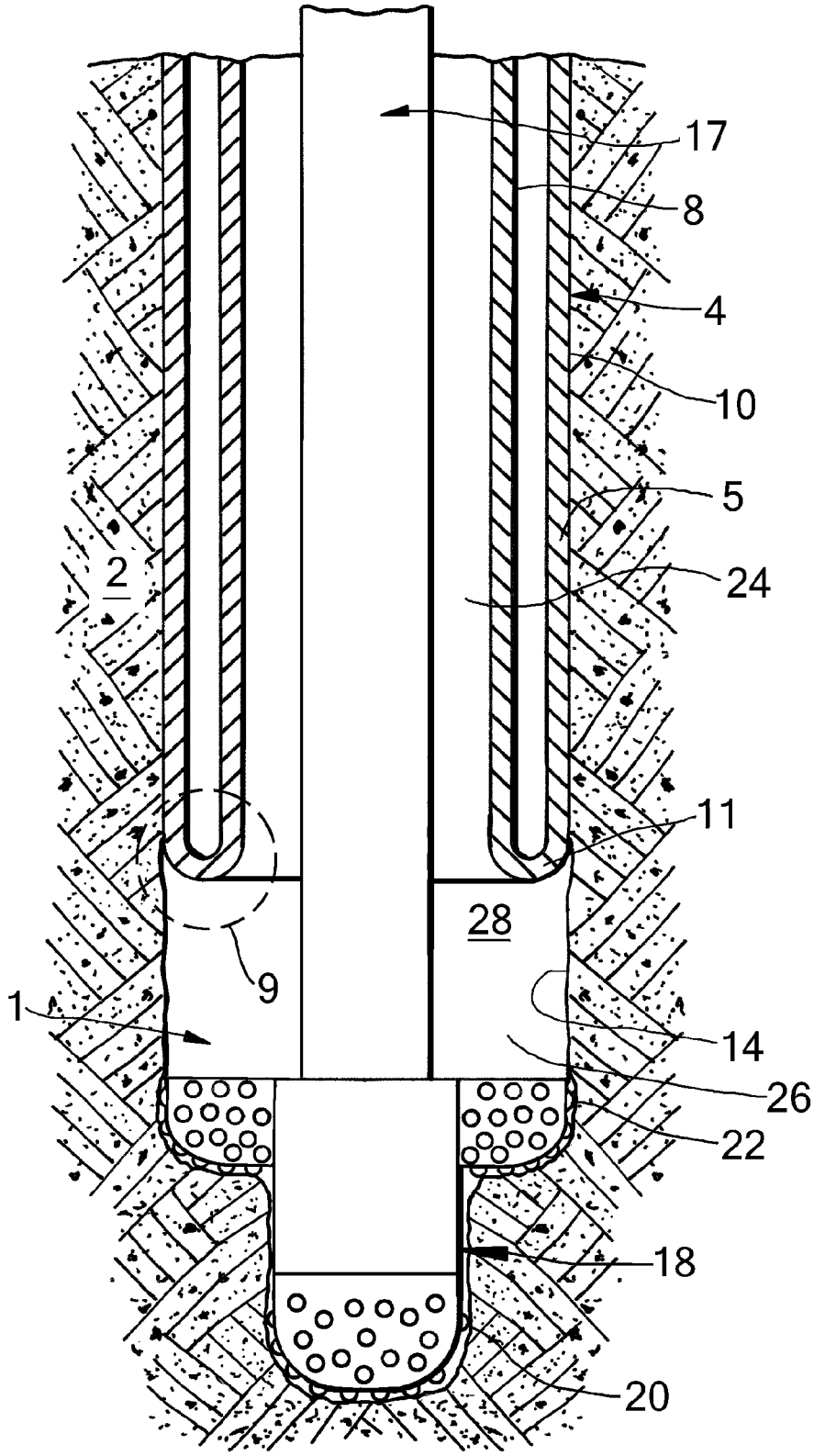
17
8
4
10
5
2
24
11
28
9
1
14
26
22
18
20

METHOD OF DRILLING A WELLBORE

PRIORITY CLAIM

The present application claims priority to PCT Application EP2008/066298, filed 24 Dec. 2008, which in turn claims priority from European Application EP08100116.6, filed 4 Jan. 2008.

TECHNICAL FIELD OF THE INVENTION

The present invention relates to a method of drilling a wellbore into an earth formation, whereby an expanded tubular element is employed in the wellbore.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that casing extends from surface into the wellbore and that a liner extends from a certain depth further into the wellbore. However, in the context of this disclosure the terms "casing" and "liner" are used interchangeably and without such intended distinction.

In conventional wellbore construction, several casings are installed at different depth intervals, in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a system for expanding a tubular element in a wellbore whereby the tubular element, in unexpanded state, is initially attached to a drill string during drilling of a new wellbore section.

To expand such wellbore tubular element, generally a conical expander is used with a largest outer diameter substantially equal to the required tubular diameter after expansion. The expander is pumped, pushed or pulled through the tubular element. Such method can lead to high friction forces between the expander and the tubular element. Also, there is a risk that the expander becomes stuck in the tubular element.

EP 0044706 A2 discloses a flexible tube of woven material or cloth that is expanded in a wellbore by eversion to separate drilling fluid pumped into the wellbore from slurry cuttings flowing towards the surface.

However there is a need for an improved method of drilling a wellbore whereby an expanded tubular element is employed in the wellbore.

SUMMARY OF THE INVENTION

In accordance with the invention there is provided a method of drilling a wellbore, the method comprising:

a) arranging a drill string and an expandable tubular element in the wellbore whereby a lower end portion of the wall of the tubular element extends radially outward and in axially reverse direction so as to form an expanded tubular section extending around a remaining tubular section of the tubular element, wherein the drill string extends through the remaining tubular section;

b) axially extending the expanded tubular section by moving the remaining tubular section downward relative to the expanded tubular section so that said lower end portion of the wall bends radially outward and in axially reverse direction, wherein the expanded tubular section covers the wellbore wall in an upper portion of the wellbore;

c) operating the drill string so as to drill a lower portion of the wellbore; and d) inducing a compound to be transferred between the lower portion of the wellbore and a layer of the earth formation surrounding the lower portion of the wellbore.

By moving the remaining tubular section downward relative to the expanded tubular section, the tubular element is effectively turned inside out whereby the tubular element is progressively expanded without the need for an expander to be pushed, pulled or pumped through the tubular element. The expanded tubular section can form a casing or liner in the wellbore.

Furthermore, since the wall of the upper wellbore portion is covered by the expanded tubular section, it is ensured that the compound is transferred between the wellbore and said layer surrounding the lower wellbore portion, and not to between the wellbore and a layer of the rock formation surrounding the upper wellbore portion. In this manner it is achieved that any compound that is transferred between the wellbore and the surrounding formation during drilling of the wellbore can be precisely allocated to a specific earth formation layer traversed by the wellbore.

Suitably, the compound transfers from said layer of the earth formation into the lower portion of the wellbore, and wherein the method further comprises measuring a characteristic relating to said compound. The characteristic can be measured in the wellbore or at surface. For example, the compound is a pore fluid contained in the earth formation, and the measured characteristic is selected from permeability of the earth formation, composition of the pore fluid and pressure of the pore fluid.

Preferably the wellbore is drilled in underbalance drilling mode, whereby the wellbore contains a drilling fluid exerting a fluid pressure to the wellbore wall in said lower portion of the wellbore, and whereby said fluid pressure is lower than the pore fluid pressure.

In another embodiment of the method of the invention, the compound is a treatment fluid that is injected via the wellbore into said earth formation layer.

Suitably the drill string is operated simultaneously with moving the remaining tubular section downward in the wellbore.

In order to achieve that the expanded tubular section retains its expanded form, it is preferred that the wall of the tubular element includes a material that is plastically deformed in the bending zone, so that the expanded tubular section automatically remains expanded as a result of said plastic deformation. Plastic deformation refers in this respect to permanent deformation, as occurring during deformation of various ductile metals upon exceeding the yield strength of the material. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

BRIEF DESCRIPTION OF THE DRAWING

The invention will be described hereinafter in more detail and by way of example, with reference to the accompanying drawing in which:

FIG. 1 schematically shows, in longitudinal section, an embodiment of a wellbore system used with the method of the invention.

DETAILED DESCRIPTION OF THE PREFERRED EMBODIMENTS

Referring to FIG. 1 there is shown a wellbore 1 extending into an earth formation 2 having pores containing hydrocarbon fluid. A tubular element in the form of liner 4 extends from surface 6 downwardly into the wellbore 1. The liner 4 has been partially radially expanded by eversion of its wall 5 whereby a radially expanded tubular section 10 of the liner 4 has been formed of outer diameter substantially equal to the wellbore diameter. A remaining tubular section of the liner 4, in the form of unexpanded liner section 8, extends from surface 6 concentrically into the expanded tubular section 10.

Due to eversion of the liner 4, the wall 5 of the liner 4 is bent radially outward and in axially reverse (i.e. upward) direction so as to form a U-shaped lower wall section 11 interconnecting the unexpanded liner section 8 and the expanded liner section 10. The U-shaped lower wall section 11 defines a bending zone 9 of the liner.

The expanded liner section 10 is axially fixed to the wellbore wall 14 by virtue of frictional forces between the expanded liner section 10 and the wellbore wall 14 resulting from the expansion process. Alternatively, or additionally, the expanded liner section 10 can be anchored to the wellbore wall by any suitable anchoring means (not shown).

A drill string 17 extends from surface through the unexpanded liner section 8 to the bottom of the wellbore 1. The drill string 17 is at its lower end provided with a drill bit 18 comprising a pilot bit 20 with gauge diameter slightly smaller than the internal diameter of the unexpanded liner section 8, and a reamer section 22 with gauge diameter adapted to drill the wellbore 1 to its nominal diameter. The reamer section 22 is radially retractable to an outer diameter allowing it to pass through unexpanded liner section 8, so that the drill string 17 can be retrieved through the unexpanded liner section 8 to surface.

Further, the expanded liner section 10 covers the wall 14 of the wellbore 1 in an upper portion 24 thereof and extends up to a short distance above the drill bit 18, thus leaving a short open-hole wellbore portion 26 (below liner 4) uncovered. A body of drilling fluid 28 extends into the interior of the unexpanded liner section 8 and into the open-hole wellbore portion 26.

During normal operation, a lower end portion of the liner 4 is initially everted, which means that the lower end portion is bent radially outward and in axially reverse direction. The U-shaped lower section 11 and the expanded liner section 10 are thereby initiated. Subsequently, the short length of expanded liner section 10 that thus formed is anchored to the wellbore wall 14 by any suitable anchoring means. Depending on the geometry and/or material properties of the liner 4, the expanded liner section 10 alternatively can become anchored to the wellbore wall automatically due to friction between the expanded liner section 10 and the wellbore wall 14.

The unexpanded liner section 8 is then gradually moved downward by application of a sufficiently large downward force thereto, whereby the unexpanded liner section 8 becomes progressively everted in the bending zone 9. In this manner the unexpanded liner section 8 is progressively transformed into the expanded liner section 10. The bending zone 9 moves in downward direction during the eversion process, at approximately half the speed of the unexpanded liner section 8.

Since the length, and hence the weight, of the unexpanded liner section 8 gradually increases, the magnitude of the downward force can be gradually lowered in correspondence with the increasing weight of liner section 8. As the weight increases, the downward force eventually may need to be replaced by an upward force to prevent buckling of liner section 8.

Simultaneously with downward movement of the unexpanded liner section 8 into the wellbore, the drill string 17 is operated to rotate the drill bit 18 whereby the pilot bit 20 drills an initial portion of the borehole and the reamer section 22 enlarges the borehole to the final gauge diameter. The drill string 17 thereby gradually moves downward into the wellbore 1. The unexpanded liner section 8 is moved downward in a controlled manner and at substantially the same speed as the drill string 17, so that it is ensured that the bending zone 9 remains at a short distance above the drill bit 18. Controlled lowering of the unexpanded liner section 8 can be achieved, for example, by controlling the downward force, or upward force, referred to hereinbefore. Suitably, the unexpanded liner section 8 is supported by the drill string 17, for example by bearing means (not shown) connected to the drill string, which supports the U-shaped lower section 11. In that case the upward force suitably is applied to the drill string and transmitted via the bearing means to the unexpanded liner section 8. Furthermore, at least a portion of the weight of the unexpanded liner section 8 can be transferred to the drill string 17 by the bearing means, so as to provide a thrust force to the drill bit 18.

During drilling with the drill string 17, a stream of drilling fluid is pumped via a conventional fluid passage of the drill string 17 into the open-hole wellbore portion 26. From there the stream of drilling fluid, with drill cuttings entrained therein, is discharged to surface via the annular space formed between the drill string 17 and the unexpanded liner section 8. The specific weight, and possibly also the pump rate, of the drilling fluid is controlled so that the fluid pressure in the open-hole wellbore portion 26 is slightly below the pressure of the hydrocarbon fluid in the pores of the earth formation 2. As a result hydrocarbon fluid enters into the open-hole portion 26 and flows with the discharged stream of drilling fluid to surface where the composition, the pressure, and the inflow rate of the hydrocarbon fluid are determined in conventional manner. Also, the permeability of the earth formation surrounding the open-hole wellbore portion 26 is determined from the inflowing hydrocarbon fluid. Since the expanded liner section 10 covers substantially the entire wall of the wellbore, except for the open-hole lower portion 26, no formation fluid enters into the wellbore other than into the short open-hole lower portion 26. In this manner it is achieved that the measured characteristics, such as pore fluid composition, pore fluid pressure and formation permeability, can be precisely allocated to the earth formation at a specific depth.

In case another compound of the earth formation enters into the open-hole wellbore portion 26, for example sand particles, specific characteristics of such compound and/or the surrounding rock formation can be determined in a similar manner.

When it is required to retrieve the drill string 17 to surface, for example when the drill bit 18 is to be replaced or when drilling of the wellbore 1 is complete, the reamer section 22 is brought to its radially retracted mode. Subsequently the drill string 17 is retrieved through the unexpanded liner section 8 to surface.

With the wellbore system of the invention, it is achieved that the wellbore is progressively lined with the everted liner directly above the drill bit during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

In order to reduce friction forces between the unexpanded and expanded liner sections during the expansion process, suitably a friction-reducing layer, such as a Teflon layer, is applied between the tube and the unexpanded and expanded liner sections. For example, a friction reducing coating can be applied to the outer surface of the liner before expansion, or to the inner and/or outer surface of the tube.

Instead of expanding the expanded liner section against the wellbore wall (as explained in the detailed description), the expanded liner section can be expanded against the inner surface of another tubular element already present in the wellbore.

The invention claimed is:

1. A method of drilling a wellbore in an earth formation, the method comprising:

a) arranging a drill string and an expandable tubular element in the wellbore whereby a lower end portion of the wall of the tubular element extends radially outward and in an axially reverse direction so as to form an expanded tubular section extending around a remaining tubular section of the tubular element, wherein the drill string extends through the remaining tubular section;

b) axially extending the expanded tubular section by moving the remaining tubular section downward relative to the expanded tubular section so that said lower end portion of the wall bends radially outward and in an axially reverse direction, wherein the expanded tubular section covers the wellbore wall in an upper portion of the wellbore;

c) operating the drill string so as to drill a lower portion of the wellbore, wherein a drilling fluid is pumped into an open-hole wellbore portion via the drill string and is discharged to surface via an annular space between the drill string and the remaining tubular section; and d) transferring a compound from a layer of the earth formation surrounding the lower portion of the wellbore into the lower portion of the wellbore, wherein the method further comprises measuring a characteristic relating to said compound.

2. The method of claim 1 wherein said characteristic is measured at a location selected from a surface location and a location in the wellbore.

3. The method of claim 1 wherein said compound is a pore fluid contained in the earth formation, and wherein said characteristic is selected from the group consisting of: permeability of the earth formation layer, porosity of the earth formation layer, composition of the pore fluid, and pressure of the pore fluid.

4. The method of claim 3, wherein the wellbore contains a drilling fluid exerting a fluid pressure on the wellbore wall in said lower portion of the wellbore, and wherein said fluid pressure is lower than the pore fluid pressure.

5. The method of claim 1 wherein the drill string is operated simultaneously with moving the remaining tubular section downward in the wellbore.

6. The method of claim 1 wherein the wall of the tubular element includes a material subject to plastic deformation during said bending of the wall so that the expanded tubular section retains an expanded shape as a result of said plastic deformation.

7. The method of claim 1 wherein the remaining tubular section is subjected to an axially compressive force inducing said downward movement of the remaining tubular section.

8. The method of claim 7, wherein said axially compressive force at least partly results from the weight of the remaining tubular section.

* * * * *